US007505600B2

(12) United States Patent
Dryer

(10) Patent No.: US 7,505,600 B2
(45) Date of Patent: Mar. 17, 2009

(54) PROCESSOR CONTROL OF AN AUDIO TRANSDUCER

(75) Inventor: Joseph E. Dryer, Houston, TX (US)

(73) Assignee: Floyd Bell, Inc., Columbus, OH (US)

( * ) Notice: Subject to any disclaimer, the term of this patent is extended or adjusted under 35 U.S.C. 154(b) by 951 days.

(21) Appl. No.: 11/094,685

(22) Filed: Mar. 30, 2005

(65) Prior Publication Data

US 2005/0219040 A1 Oct. 6, 2005

Related U.S. Application Data

(60) Provisional application No. 60/558,601, filed on Apr. 1, 2004.

(51) Int. Cl.
*H04R 3/00* (2006.01)

(52) U.S. Cl. ..... 381/111; 381/116; 381/120; 330/174

(58) Field of Classification Search ..... 381/111–117, 381/120, 123, 190; 340/384.6, 384.7, 384.71; 330/169, 174, 297
See application file for complete search history.

(56) References Cited

U.S. PATENT DOCUMENTS

| | | | | |
|---|---|---|---|---|
| 4,464,660 | A * | 8/1984 | Ginn | 340/870.38 |
| 5,506,532 | A * | 4/1996 | Milazzo | 327/175 |
| 5,633,625 | A | 5/1997 | Gaub et al. | |
| 5,956,410 | A * | 9/1999 | Brisson | 381/94.1 |
| 6,104,248 | A * | 8/2000 | Carver | 330/297 |
| 6,310,540 | B1 | 10/2001 | Burnett et al. | |
| 6,650,232 | B1 | 11/2003 | Strohbeck et al. | |
| 6,661,285 | B1 * | 12/2003 | Pompei et al. | 330/251 |
| 7,132,891 | B1 * | 11/2006 | Dening et al. | 330/297 |
| 2002/0136418 | A1 * | 9/2002 | Zavis et al. | 381/114 |
| 2007/0057778 | A1 * | 3/2007 | Prince et al. | 340/384.6 |

* cited by examiner

*Primary Examiner*—Xu Mei
(74) *Attorney, Agent, or Firm*—Frank H. Foster; Kremblas, Foster, Phillips & Pollick

(57) ABSTRACT

A controller, either a microprocessor or finite state machine, is used to generate a pulse train whose frequency and duty cycle can be varied to alter the frequency and amplitude of the output of a driven audio transducer. The ability to control both frequency and amplitude allows programmatic synthesis of many audio effects such as steady tones, warbles, beeps, sirens and chimes with no hardware or circuit changes. The transducer can be a piezoelectric bender or a speaker. The output of the controller controls a switch that builds current in an inductor when the switch is on. When the switch is turned off, the energy stored in the inductor is dumped into the audio transducer, either directly or through intermediate capacitor storage. This allows the generation of voltages across the transducer many times the supply voltage.

25 Claims, 6 Drawing Sheets

PROCESSOR CONTROL OF AN AUDIO TRANSDUCER

(b) CROSS-REFERENCES TO RELATED APPLICATIONS

This application claims the benefit of U.S. Provisional Application No. 60/558,601 filed Apr. 1, 2004.

(c) STATEMENT REGARDING FEDERALLY-SPONSORED RESEARCH AND DEVELOPMENT (Not Applicable)

(d) REFERENCE TO AN APPENDIX (Not Applicable)

(e) BACKGROUND OF THE INVENTION

1. Field of the Invention

This invention generally relates to electronic sound generating devices. More particularly the invention relates to circuits for controlling and driving such devices and allowing the generation of a variety of sounds from such sound generating devices.

2. Description of the Related Art

Piezoelectric transducers have been commonly used for the generation of audio tones in a number of applications. They are characterized by low cost, reliability and high audio output. A drawback of the use of one type of piezoelectric transducer, piezoelectric benders, to generate the tones is the relatively high Q of such circuit elements, requiring a precise drive frequency for maximum output, and the high voltages needed to generate the high output sound levels.

Traditionally piezoelectric audible alarms have been driven by square wave drives from oscillator circuits. The high voltages desirable across the driven piezoelectric device are achieved by driving bridge drivers, step-up transformers or autotransformers or through an inductor in a flyback mode. This allows little flexibility once the components are inserted into the circuit. The use of a fixed digital drive in particular allows little adjustment of the sound volume. Coil speakers or polymer piezoelectric speakers have also been used as audio transducers and present similar problems in designing flexible drive circuits.

It is the object of the invention to provide a circuit and method of signal modulation for the audio transducer to provide both high drive power and flexible control.

(f) BRIEF SUMMARY OF THE INVENTION

The invention is a circuit for generating sound in the audible frequency range and includes the conventional input voltage terminals for powering the circuit. An audio transducer is driven by a driving circuit that includes at least one energy storing inductor and one or more electronic switches adapted for energizing the energy-storing inductor and for transferring energy from the inductor to the audio transducer. A microprocessor circuit or controller generates a stream of pulses at a controlled rate and with a controlled duty cycle under program control. The controller has one or more controller outputs coupled to the one or more electronic switches for controlling energy storage in one or more inductors and the energy transfer from the inductors to the transducer. The controller has a finite state machine program that outputs the sequence of pulses to the one or more switches of the driving circuit at a rate and duty cycle to generate a desired audio tone and amplitude in the transducer. The controller can modify the rate and duty cycle in response to measurements of the transducer state or transducer environment.

(g) BRIEF DESCRIPTION OF THE SEVERAL VIEWS OF THE DRAWINGS

FIG. 1 is a block diagram of the audio system showing the relationship of a regulator block 1, a controller block 2, a driver block 3 and a feedback block 4.

FIG. 2 is a detailed electric circuit diagram showing a preferred embodiment of the audio system comprising 78L05 regulator 1, a controller block 2 comprising a PIC12C671 2 driving a drive block 3 comprising an energy-storage inductor 10 with blocking diode 13. The feedback, block 4, in this embodiment is not used.

FIG. 3 is a diagram showing the significant signals from FIG. 2. The drive voltage from the controller 2 is shown together with inductor 10 current and the voltage across FET 11.

FIG. 4 is a detailed electric circuit diagram showing a preferred embodiment with the regulator, controller and driver blocks of FIG. 2 combined with a feedback block 4 which delivers to the feedback input of controller 2 a signal representative of the current delivered to transducer 12.

FIG. 5 is a detailed electric circuit diagram showing a preferred embodiment with the regulator, controller and driver blocks of FIG. 2 combined with a feedback block 4 which delivers to the feedback input of controller 2 a signal representative of the voltage across transducer 12.

FIG. 6 is a detailed electric circuit diagram showing a preferred embodiment with the regulator, controller and driver blocks of FIG. 2 combined with a feedback block 4 which delivers to the feedback input of controller 2 a signal from an additional transducer electrode excited by the piezoelectric voltage in the transducer.

FIG. 7 is a detailed electric circuit diagram showing a preferred embodiment with the regulator, controller and driver blocks of FIG. 2 combined with a control input block 4 which, while driver block 3 is de-energized, delivers to the control input of controller 2 a signal representative of the ambient noise incident on transducer 12.

Figure 10:
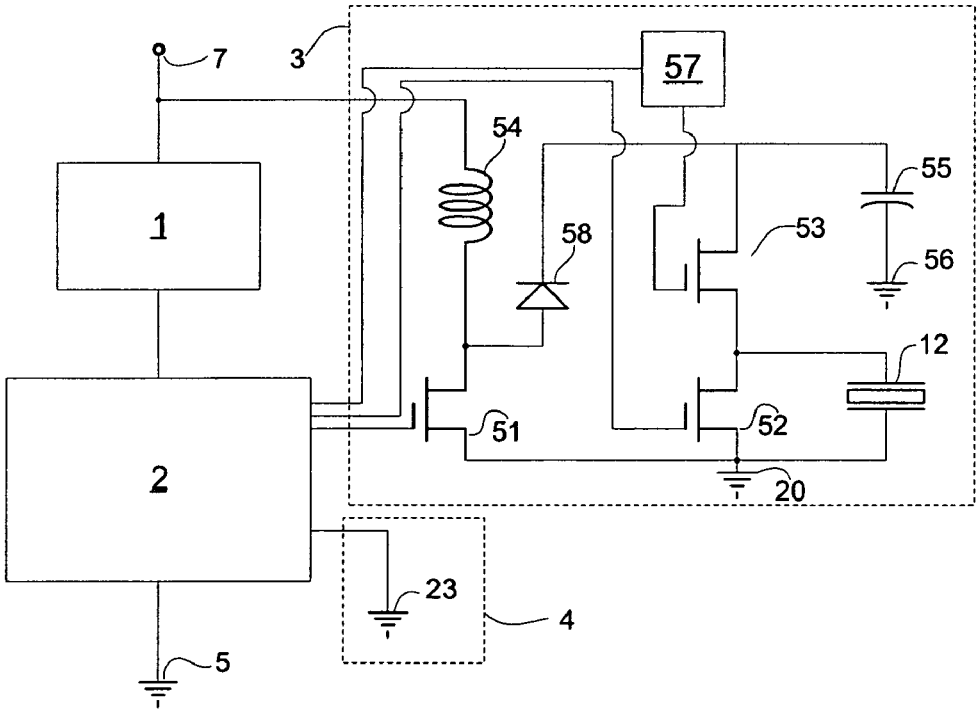

FIG. 10 is a detailed electric circuit diagram showing a preferred embodiment with switch 51, under the control of controller 2, storing energy from the source 7 in inductor 54. This energy is then transferred to capacitor 55. The energy is then delivered to the transducer by a half-bridge drive.

Figure 11:
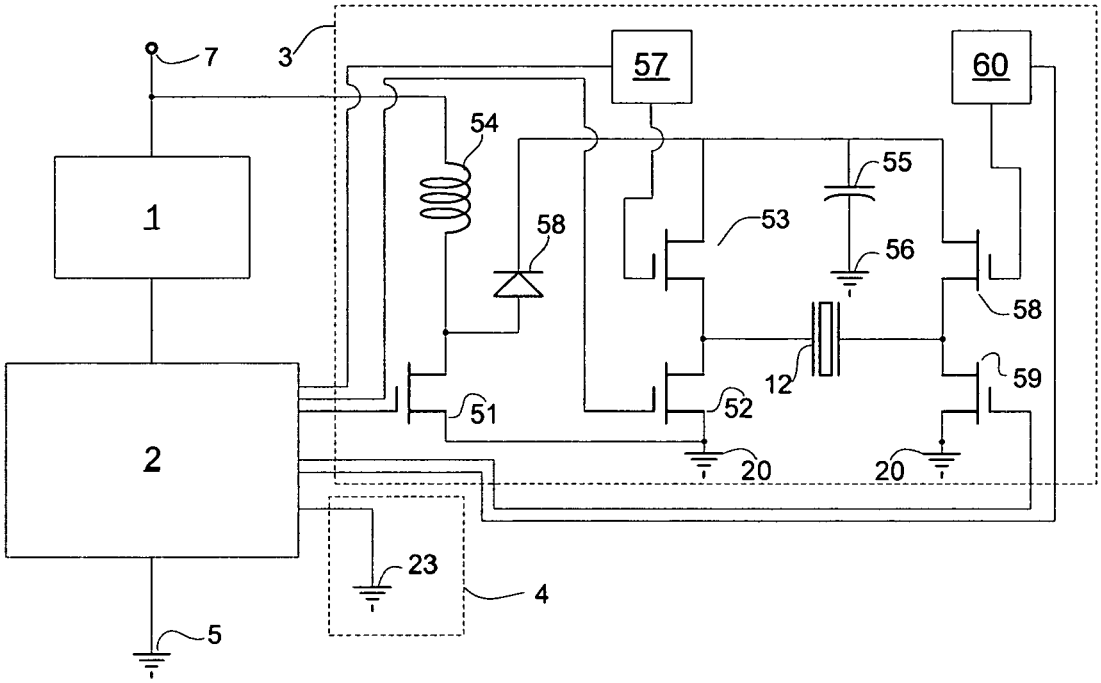

FIG. 11 is a detailed electric circuit diagram showing a preferred embodiment with switch 51, under the control of controller 2, storing energy from the source 7 in inductor 54. This energy is then transferred to capacitor 55. The energy is then delivered to the transducer by a full-bridge drive.

In describing the preferred embodiment of the invention that is illustrated in the drawings, specific terminology will be resorted to for the sake of clarity. However, it is not intended that the invention be limited to the specific term so selected and it is to be understood that each specific term includes all technical equivalents that operate in a similar manner to accomplish a similar purpose. For example, the word connected or term similar thereto is often used. They are not limited to direct connection, but include connection through other circuit elements where such connection is recognized as being equivalent by those skilled in the art. In addition, many circuits are illustrated which are of a type that performs well known operations on electronic signals. Those skilled in the art will recognize that there are many, and in the future may be additional, alternative circuits which are recognized as equivalent because they provide the same operations on the signals.

(h) DETAILED DESCRIPTION OF THE INVENTION

The following discusses a controller function. It is meant that a controller is any device for performing the functions of a finite state machine, defined as a model of computation consisting of a set of states, a start state, an input alphabet, and a transition function that maps input symbols and current states to a next state. Computation begins in the start state with an input string. It changes to new states depending on the transition function. Examples of a finite state machine are microprocessors, microcontrollers, PLAs, PALs, and memories combined with sequential clocking.

Figure 1:
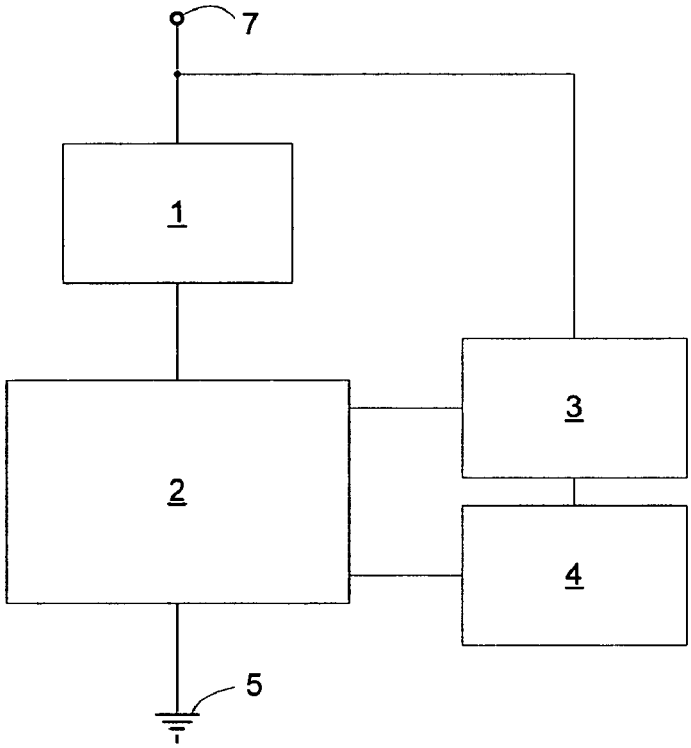
Figure 2:
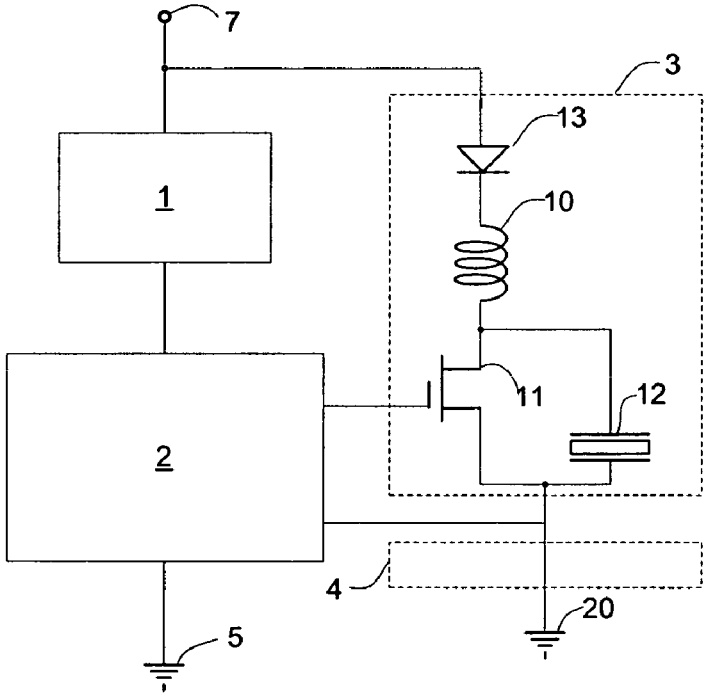

Directing attention to FIG. 2, a detailed electric circuit diagram of a preferred embodiment is shown. An input voltage is applied between a positive terminal 7 and ground 5. This input voltage is regulated by the voltage regulator 1 and applied to controller 2 in a method well known to the practice, as, for example, by a 78L05 voltage regulator. Controller 2 is a programmed controller such as a Microchip PIC12C671, where the connection from regulator 1 would be to pin 1, the VDD supply and ground 5 would be applied to pin 8, the VSS supply. The operating frequency of the control oscillator for controller 2, the PIC12C671, is the internal oscillator, trimmed during production to match the piezoelectric transducer by adaptively trimming the OSCCAL REGISTER in the processor with the trimmed frequency being programmatically used to modify the internal oscillator frequency of the PIC12C671. Alternatively an external resonant circuit or component, such as a ceramic resonator, can be used to more accurately determine the operating frequency. FET 11 and inductor 10 are used in this embodiment as the drive circuit shown as box 3 in FIG. 1 for driving the transducer 12. Preferably the transducer 12 is a piezoelectric transducer, but could alternatively be a polymer speaker or coil speaker. The control output from the PIC12C671 can be, for example, GP4 (pin 3) and is used to drive the gate of an N-channel FET 11. The source of FET 11 is connected to ground 20. This embodiment illustrates no feedback so the box 4 in FIG. 1 is in this case a ground. The drain of FET 11 is connected to the positive input voltage 7 through a series connection of diode 13 and inductor 10, such as a choke, and to ground 20 through the transducer 12 as shown. Although the Microchip PIC controller and a 78L05 regulator are disclosed, many functionally equivalent processors and regulators may be substituted. FET 11 may be replaced with other components for performing the electronic switch function such as a bipolar transistor and base limiting resistor, unijunction transistor or IGBT with equivalent operation. It should be obvious to those skilled in the art that equivalent circuits can perform the same functions, such as the use of a negative supply at point 7, the use of a negative voltage regulator in position 1, reversing the diodes in block 3 and the replacement of the electronic switch function by the reverse polarity analog (P-channel FET for N-channel FET, PNP transistor for an NPN transistor, etc.).

Figure 3:
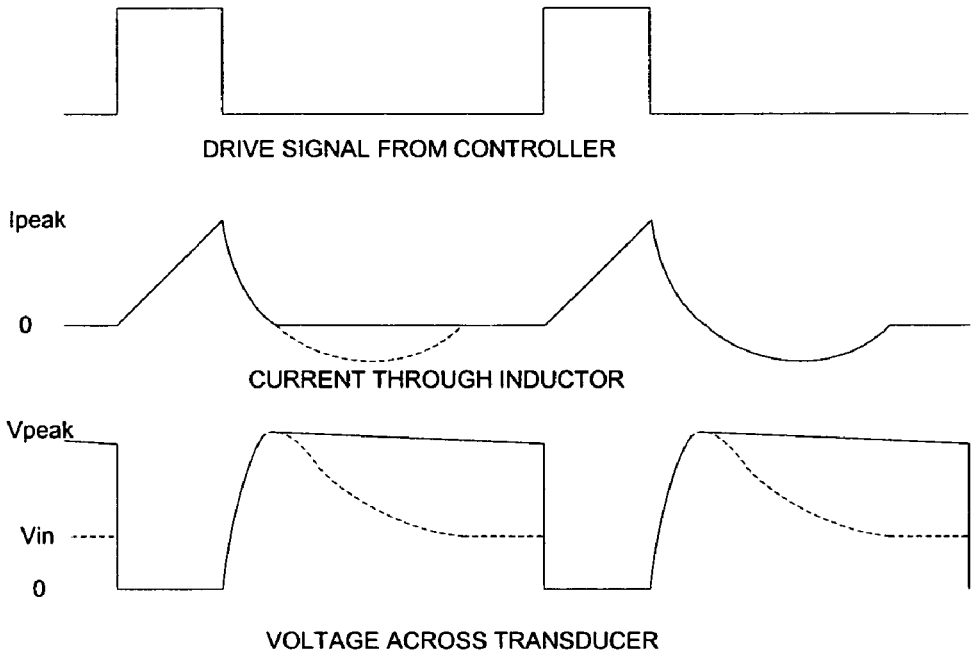

The operation of this circuit can be shown with reference to FIG. 3. The top line in FIG. 3 represents the drive from controller 2 driving the gate of FET 11. When the drive goes high to turn on FET 11, the current through inductor 10 starts to increase as shown on the second line. This represents energy being stored in inductor 10. When the drive from controller 2 goes low, turning off FET 11, the current through inductor 10 then passes through transducer 12 causing the voltage across the transducer to increase as shown in the bottom line in FIG. 3. Without the presence of diode 13 this current would reverse direction as shown in the dotted line in the middle of FIG. 3, with a decrease in the voltage across the transducer 12 as shown in the dotted line in the bottom of FIG. 3. Diode 13 blocks this flow and results in the voltage across transducer 12 remaining near its peak value Vpeak. This increased voltage results in an increased audible sound output from the transducer 12. The peak voltage can be multiples of the supply voltage 7.

The audible sound output amplitude can be reduced from the peak value by decreasing the duty cycle of the drive signal shown at the top of FIG. 2. If the on time is halved, for instance, the Ipeak is approximately halved, and the energy stored in the inductor is reduced by a factor of four. Controller 2 thus can control the output of transducer 12 by controlling the pulse width in addition to controlling the frequency of the audio output by controlling the pulse rate. This control of the output frequency and duty cycle can be programmatically accomplished using many techniques well known to those skilled in the art. It is thus possible to modify the frequency and amplitude of the output signal programmatically to achieve, for example, siren, warble, intermittent tomes, and chime effects, by the appropriate variation of frequency and duty cycle without the addition of additional controlling components. In addition, these effects can be modified in response to signals on a control input of controller 2. For one example, depending on the control input, the output could go from silent to a constant tone to a warble.

The controller can introduce additional sub-cycle and super-cycle effects to enhance the transducer control. It is possible to drive the transducer at a higher frequency and modify the normal square-wave drive to more discrete steps to closer approximate a sine-wave drive. This reduces stress in the transducer and improves reliability and power capability. A technique that can be used when very low amplitudes are required, where the pulse width becomes too small, is the use of output reduction by means of cycle skipping, where some output pulses are skipped entirely. Since the transducer is a resonant circuit and the ear is not sensitive to the slight amplitude variations cycle-to-cycle, the skipping of cycles allows a finer adjustment of very small outputs such as at the end of chime tones. It should be noted that it is not necessary that these alternating outputs be driven 180 degrees out of phase. For example, as amplitude is built up using a full bridge drive the circuit could first operate as a half bridge for finer amplitude control and later add the other half bridge for increased amplitude. In the sub-cycle operation the positive and negative values of the sine wave would commonly be emulated using non-symmetric drive phase angles, i.e. the negative controller output would have a different duty cycle than the positive controller output.

The maximum RMS voltage across the transducer will be achieved with approximately a 50% duty cycle. This is accomplished when inductor 10 is sized so that energy corresponding to the peak stress desired in transducer 12 is stored in inductor 10 at Ipeak. Ipeak is the input voltage 7 (less any drops in diode 13 and FET 11) divided by the product of the inductance of the inductor 10 and twice the drive frequency.

The power delivered to transducer 12 from the circuit of FIG. 2 is the power input from power supply 7 less any losses in the components. The variable part of the power delivered to transducer 12 is the power output as sound. The power output can be maximized by maximizing the power delivered to transducer 12. Since many transducers in combination with their sound boxes represent high Q elements, the transducer must be driven at its resonant frequency for maximum output.

Figure 4:
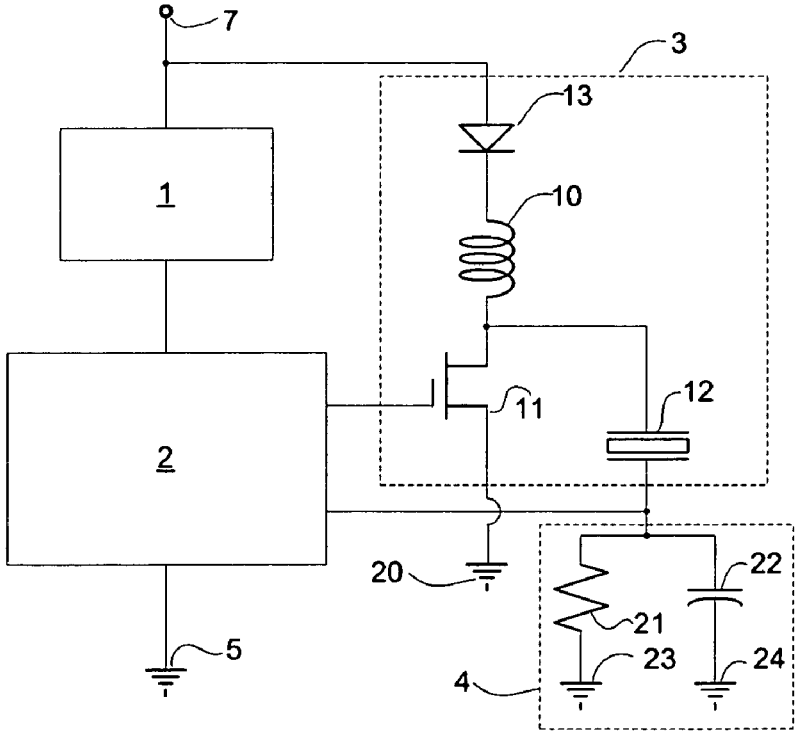

FIG. 4 represents another preferred embodiment illustrating the use of feedback to maximize the audio power output. The current through transducer 12 is filtered and available for measurement at the feedback input to controller 2. For example, this could be pin AN1 (pin 6) of a PIC12C671. This is accomplished by adding block 4 comprising resistor 21 to ground 23 and capacitor 22 to ground 24. The current is filtered by the RC time constant to remove any harmonics and can be measured by the internal A/D circuit in controller 2. With knowledge of the current through transducer 12, the frequency of the output pulses can be changed, preferably in a small increment, and a new measurement taken. If the change in the rate of output pulses results in an increase in the voltage measured at the node between the transducer 12 and block 4, then this is the direction of increasing output power and the rate of output pulses should again be shifted in that direction. If the change in the rate of output pulses results in a decrease in the voltage measured between the transducer 12 and block 4 then this is the direction of decreasing output power and the rate of output pulses should again be shifted in the opposite direction. This is repeated until the change in the rate of output pulses results in no change in the voltage measured between the transducer 12 and block 4. This is the point of maximum power. This process of adaptively modifying the rate of output power can be programmatically accomplished by those skilled in the art. It should be obvious to those skilled in the art that the connection to ground of switch 11 could also be routed through resistor 21 and capacitor 22 so the current feedback represents the total current through switch 11 and transducer 12.

Figure 5:
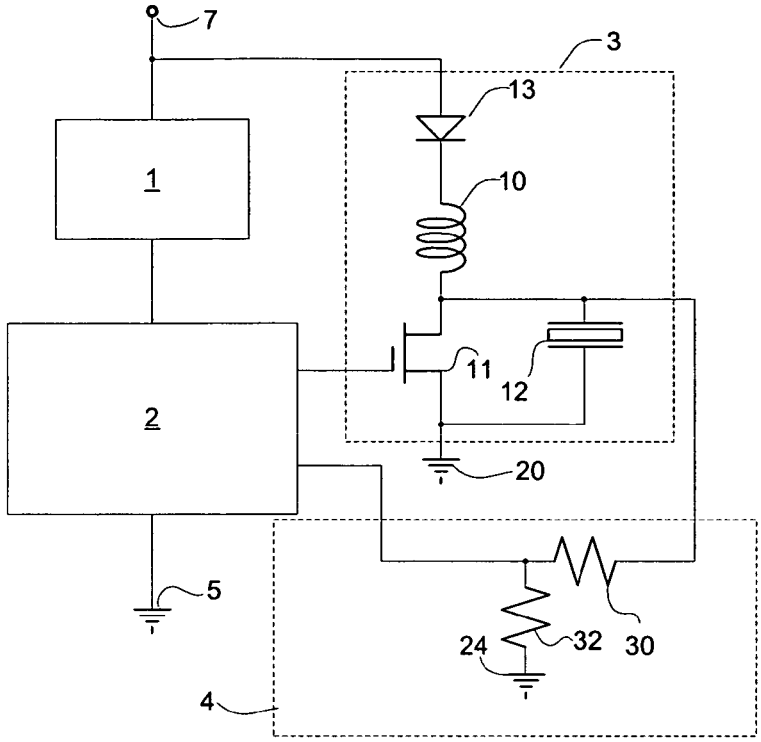

Another preferred embodiment is shown in FIG. 5. This circuit measures the peak voltage across transducer 12, which is a measure of the power delivered to the transducer. This peak voltage measurement can be used as described in the case of the current measurement to programmatically modify the drive frequency for maximum output.

Figure 6:
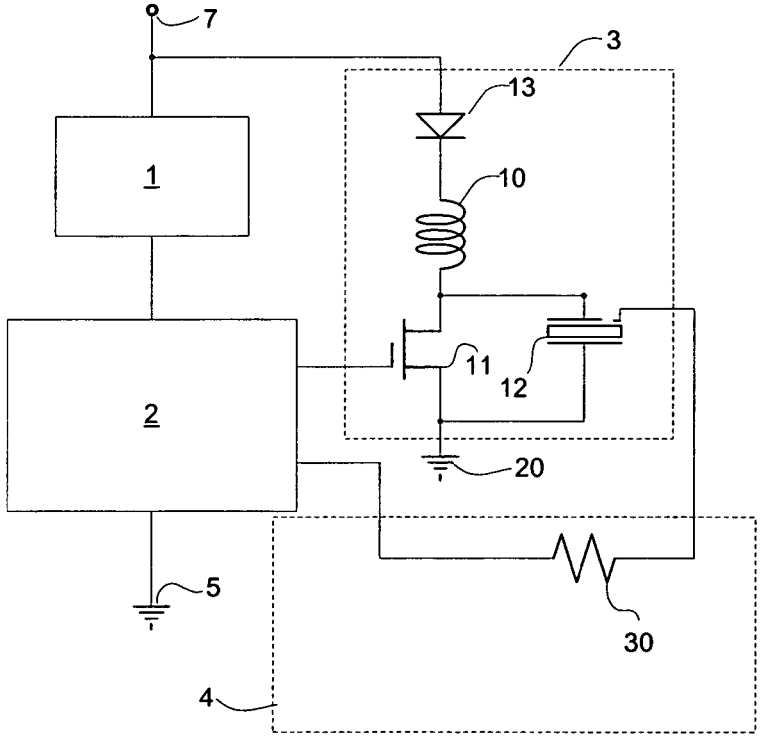

Another preferred embodiment is shown in FIG. 6. Feedback is derived from the use of a third terminal connected only to a portion of one surface of transducer 12 and unconnected to either driving terminal. Such a terminal will detect the voltage induced by piezoelectric strain and will represent the response of the transducer to the excitation. By programmatically varying the pulse rate in the direction of increasing the peak-to-peak voltage of this terminal at a given drive level by the manner discussed previously, the output can be maximized.

Figure 7:
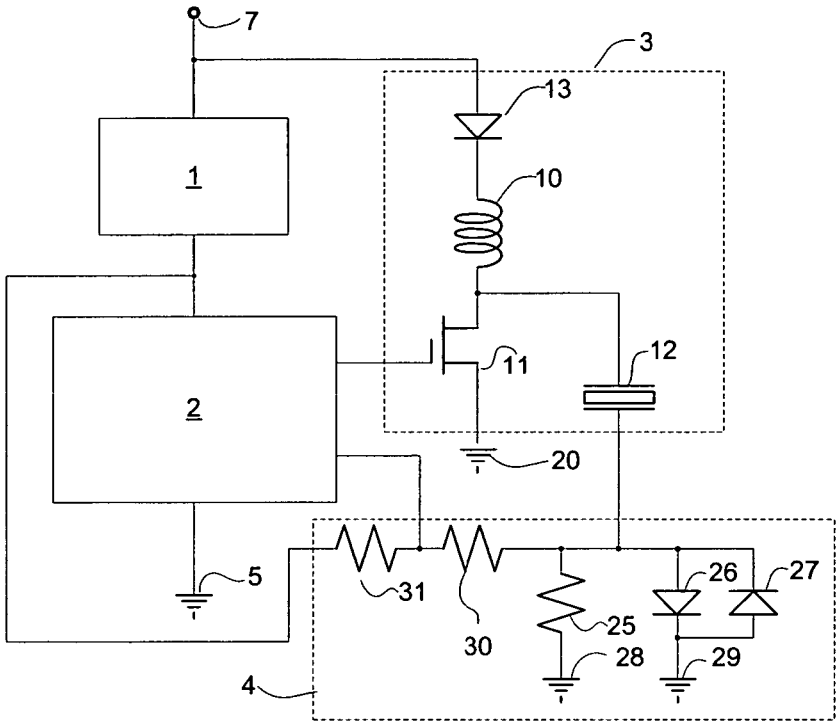

Another preferred embodiment is shown in FIG. 7. This circuit in normal operation has the operation of the current measuring resistor 21 of FIG. 4 shorted out by diodes. The new monitoring resistor 25 has diodes 26 and 27 to limit the voltage excursion of the measured voltage, allowing the use of a much larger resistor. When the unit is paused, and no longer driven by controller 2 and FET 11 is continually off, transducer 12 will now respond to ambient noise and represent ambient noise as a voltage across resistor 25, which is sized so the ambient signal will be below the breakover voltage of diodes 26 and 27. This voltage is shifted out of any negative range by resistors 30 and 31 and measured at the input of controller 2 as was done previously. Thus, with short pauses in the output, the ambient noise can be measured and the amplitude of the audio output from transducer 12 adjusted by adjusting the duty cycle so that the output can be increased during the presence of high ambient noise but could be reduced so as to not be annoying when the ambient noise is low. The use of an additional amplifier to measure this ambient is an obvious modification to those skilled in the art. An equivalent function can be achieved by the use of an additional audio receiver in place of the use of the transducer 12 with the input from the external audio receiver input into the control input of controller 2.

Figure 8:
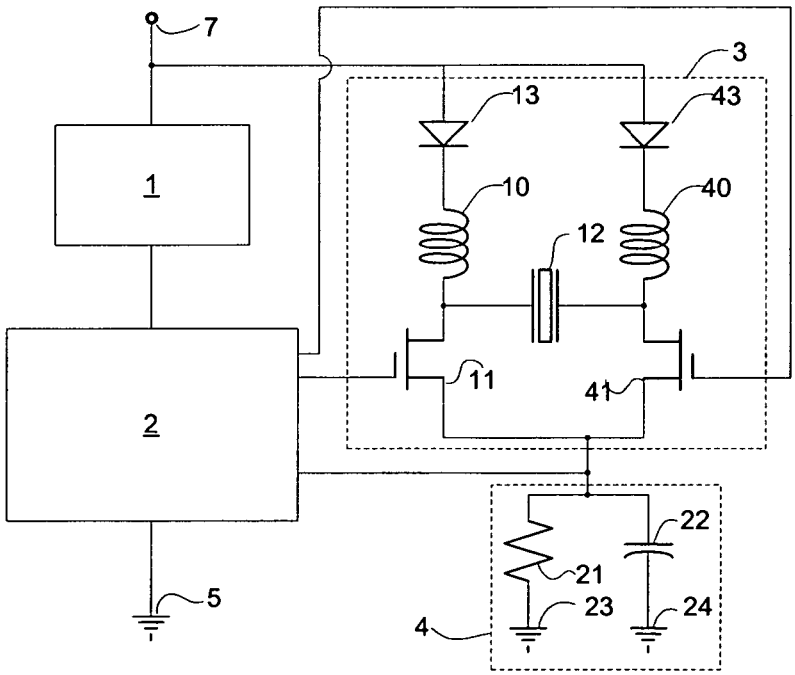
FIG. 8 is a detailed electric circuit diagram showing a preferred embodiment with two alternating drives from controller 2 that drive transducer 12 alternately from each side.

Controller 2, implemented as a microprocessor as described previously, will customarily have more than one output available. This feature can be utilized to drive the transducer with alternate polarity as in FIG. 8 where an additional drive output has been added just above the drive output shown in FIG. 4. Both approaches can be viewed as the implementation of two parallel drives of the types described previously in reference to FIG. 4. Programmatically the drives for the implementations for FIGS. 8 and 9 can provide a positive and negative duty cycle independently controlled for desired effect, and do not need to be 180 degrees out of phase. The result would be the output voltage shown in the bottom of FIG. 3 applied to one side of transducer 12 and a similar signal applied to the other side of transducer 12. Transducer 12 would then be driven up to twice the voltage seen in a similar single leg as shown in FIG. 4, or at four times the output power. In addition, the piezoelectric element in transducer 12 will have a zero volt bias and therefore with the same peak stress as when driven by a single leg circuit at one-fourth the power. FIG. 8 shows the current measured as in FIG. 4 with the exception that the charging currents of inductors 10 and 40 will also pass through the filter network, which should not affect the ability to maximize this filter voltage as a function of pulse rate to find the maximum audio output frequency.

Figure 9:
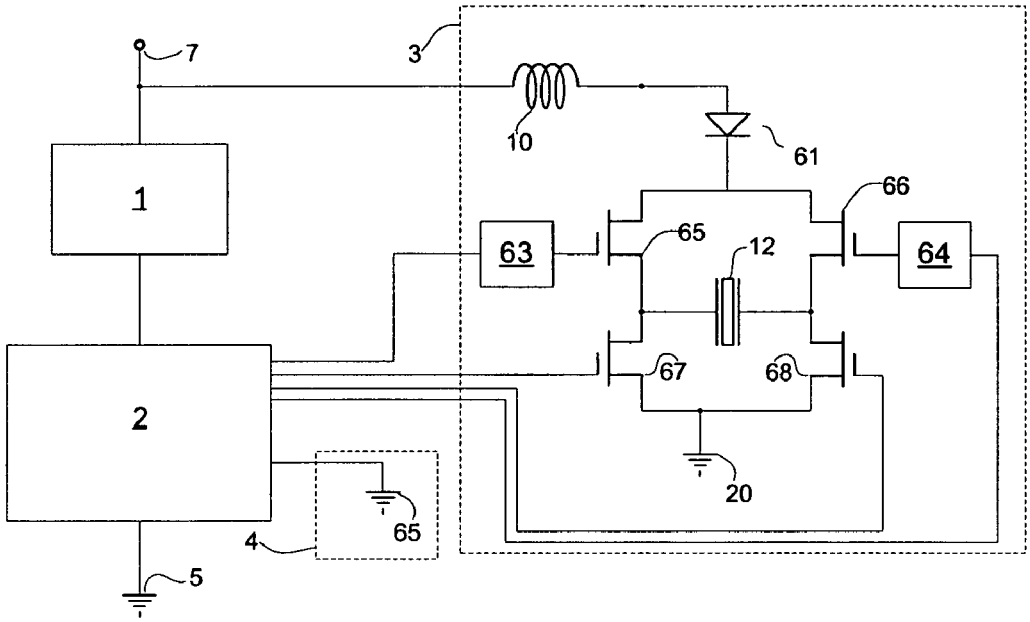
FIG. 9 is a detailed electric circuit diagram showing a preferred embodiment with a full H-bridge audio transducer drive allowing bipolar excitation with a single energy-storage inductor.

FIG. 9 represents another preferred embodiment delivering the same advantages of a bipolar drive discussed for FIG. 8 with the use of only one inductor 10. The single switch 11 in FIG. 4 has been replaced by a full bridge circuit comprised of switches 65, 66, 67 and 68. In FIG. 9, to drive the high-level switches 65 and 66 a translation circuit is usually required illustrated as 63 and 64. This is available as components from a number of sources such as International Rectifier's IPS511S. A sequence of drives from the controller first turns on only switches 65 and 67, then turns on only 65 and 68, then turns on 66 and 68, and then turns on 66 and 67, and repeats this sequence. The frequency of the output tone is controlled by the rate that this sequence is cycled, and the amplitude of the output signal is controlled by the ratio of the times that switches 65 and 67 are on plus the time that switches 66 and 68 are on compared to the total cycle time.

FIG. 10 represents another preferred embodiment illustrating the use of a separate output from controller 2 to energize and deenergize inductor 54. Before being switched into transducer 12, this energy is stored in capacitor 55, decoupling the energy storage from the transducer drive by another stage. The use of this separate controller output driving switch 51 allows the selection of an inductor energizing rate independent of the rate at which the transducer is driven through the half-bridge switches 52 and 53. The ability to drive switch 51 at a much higher rate has the advantage of potentially reducing the size and expense of inductor 54. In addition, a separate control of the excitation voltage, stored in capacitor 55 allows an additional degree of control of the output amplitude.

The circuit in FIG. 11 illustrates an enhancement of the circuit in FIG. 10 in that both connections to the transducer 12 are driven in a full-wave bridge configuration.

The circuits illustrated in FIG. 10 and FIG. 11 illustrate implementations with no feedback, i.e. block 4 is represented by a ground. It should be obvious to those skilled in the art that the feedback methods described previously, measuring the current through the transducer (illustrated in FIG. 4) or through the switches and the transducer (illustrated in FIG. 8), the voltage across the transducer (illustrated in FIG. 5) or the voltage generated by an additional transducer electrode (illustrated in FIG. 6) can be applied to these implementations. In addition, the implementation of the measurement of ambient noise, illustrated in FIG. 7 or otherwise as described previously, can be incorporated in this implementation.

It should be obvious to those skilled in the art that the preceding discussion describes several implementations of the generalized system shown in FIG. 1, where block 2 represents a control function, block 3 represents a drive function, including the excitation of an inductor to accumulate energy which is then dumped into an audio transducer, and block 4 represents a control input to the controller representing a parameter of the transducer. The various functions described previously in blocks 3 and 4 represent independent implementations of their respective functions and can be mixed in combinations which have not been jointly described. For example, FIG. 8 shows the feedback method illustrated in FIG. 4, but could also be implemented with no feedback, i.e. using the feedback block 4 of FIG. 2, or could use the voltage feedback illustrated in FIG. 5 from each side of the transducer.

While certain preferred embodiments of the present invention have been disclosed in detail, it is to be understood that various modifications may be adopted without departing from the spirit of the invention or scope of the following claims.

The invention claimed is:

1. A circuit for generating sound in the audible frequency range, the circuit including input voltage terminals for powering the circuit and comprising:

(a) an audio transducer, for transforming electrical power in the audio frequency range to audible power;

(b) a driving circuit connected to an input voltage terminal and having an output coupled to the transducer for supplying electrical drive power to the transducer in the audible frequency range, the driving circuit including at least one energy storing inductor and one or more electronic switches adapted for energizing the energy-storing inductor and for transferring energy from the inductor to the audio transducer; and (c) a controller having one or more controller outputs coupled to the one or more electronic switches for controlling said energy storage and said energy transferring, the controller having a finite state machine program which outputs a sequence of pulses to the one or more switches of the driving circuit at a rate and duty cycle to generate a desired audio tone and amplitude in said transducer.

2. A circuit in accordance with claim 1 wherein the driving circuit more particularly comprises (a) the inductor in series connection with a diode for blocking reverse current through the inductor, the series diode and inductor connected to an input voltage terminal and connected through an electronic switch to a second input voltage terminal for energizing the inductor by connecting the input voltage terminals across the diode and the inductor through the switch when the switch is turned on by the controller; and (b) the transducer having a connection between the switch and the inductor and a connection to an input voltage terminal for permitting inductor current to flow through the transducer when the switch is turned off by the controller.

3. A circuit in accordance with claim 2 wherein each electronic switch comprises an FET or bipolar transistor.

4. A circuit in accordance with claim 1 or claim 2 and further comprising a feedback circuit having an input connected to the transducer and an output connected to an input of the controller, the feedback circuit applying a signal to the controller representing the oscillation amplitude of the transducer and wherein the controller is programmed to modify the frequency or duty cycle of the controller output as a function of the feedback circuit signal.

5. A circuit in accordance with claim 4 wherein the feedback circuit is connected in series with the transducer or transducer and driving circuit for sensing the transducer current or current through the transducer and driving circuit.

6. A circuit in accordance with claim 4 wherein the feedback circuit is connected to the transducer for sensing the voltage across the transducer.

7. A circuit in accordance with claim 4 wherein the feedback circuit is connected to an electrode on the transducer for sensing the transducer strain.

8. A circuit in accordance with claim 4 wherein the controller is programmed to detect the feedback signal while the transducer is being driven in audible oscillation by the driving circuit, the controller incrementally changing the controller output frequency in one direction, detecting whether the changed frequency results in an increase or decrease of the feedback signal, changing the frequency further in the same direction when an increase of the feedback signal was the result of the frequency change and changing the frequency in the opposite direction when a decrease of the feedback signal was the result of the frequency change.

9. A circuit in accordance with claim 4 wherein the controller is programmed to detect the ambient sound level to allow a modification of the transducer drive to achieve an increased sound level and signal modulation to be recognizable in high ambient conditions without being excessive in low ambient noise conditions.

10. A circuit in accordance with claim 9 wherein the said controller detection of the sound level comprises monitoring the voltage across the audio transducer while the transducer is not being driven in audible oscillation by the driving circuit when the transducer oscillation amplitude represents ambient noise, the controller increasing the duty cycle or frequency modulation of the controller output in response to increased ambient noise and decreasing the duty cycle or frequency modulation in response to decreased ambient noise.

11. A circuit in accordance with claim 2 wherein:

(a) the driving circuit comprises two legs, each leg comprising an inductor, a diode to block reverse current through the inductor and a switch connected in series, the switch when switched on connecting the diode and inductor across the input power supply voltage terminals;

(b) each terminal of the transducer is connected between the switch and the inductor of a different one of the legs; and (c) the controller includes two outputs each connected to control a switch of a different one of the legs and programmatically apply the control signals to the two legs sequentially.

12. A circuit in accordance with claim 2 wherein:

(a) the driving circuit comprises an inductor, a diode to block reverse current through the inductor feeding four switches arranged in a full bridge circuit;

(b) each terminal of the transducer is connected between the two switches on each leg of said full bridge circuit; and (c) the controller includes two or more outputs each connected to control a switch of said full wave bridge and programmatically apply the control signals to the two legs sequentially.

13. A circuit for generating sound in the audible frequency range, the circuit including input voltage terminals for powering the circuit and comprising:

(a) an audio transducer, for transforming electrical power in the audio frequency range to audible power;

(b) an energy storing driving circuit connected to an input voltage terminal and having an output coupled to the transducer for supplying electrical drive power to the transducer in the audible frequency range, the driving circuit including at least one energy storing inductor, at least one storage capacitor and one or more electronic switches adapted for energizing the energy-storing inductor and for transferring energy from the inductor to the storage capacitor, the driving circuit applying through two or more switches the energy in said storage capacitor to the audio transducer; and (d) a controller having one or more controller outputs coupled to the one or more electronic switches for controlling said energy storage and for separately controlling said energy storage circuit and said driving circuit, the controller having a finite state machine program which outputs a sequence of pulses to the one or more switches of the driving circuit at a rate and duty cycle to generate a desired audio tone and amplitude in said transducer.

14. A circuit in accordance with claim 13 wherein said energy storing driving circuit more particularly comprises:

(a) the inductor connected to an input voltage terminal and connected through an electronic switch to a second input voltage terminal for energizing the inductor by connecting the input voltage terminals across the inductor through the switch when the switch is turned on by the controller, (b) a diode for steering the current through the inductor when the switch is turned off to an energy storage capacitor, and (c) a second switch network for alternately connecting one or more terminals of the transducer to said energy storage capacitor under controller control.

15. A circuit in accordance with claim 14 wherein each electronic switch comprises an FET or bipolar transistor.

16. A circuit in accordance with claim 13 and further comprising a feedback circuit having an input connected to the transducer and an output connected to an input of the controller, the feedback circuit applying a signal to the controller representing the oscillation amplitude of the transducer and wherein the controller is programmed to modify the frequency or duty cycle of the controller output as a function of the feedback circuit signal.

17. A circuit in accordance with claim 16 wherein the feedback circuit is connected in series with the transducer or transducer and energy storing driving circuit for sensing the transducer current or current through the transducer and energy storing driving circuit.

18. A circuit in accordance with claim 16 wherein the feedback circuit is connected to the transducer for sensing the voltage across the transducer.

19. A circuit in accordance with claim 16 wherein the feedback circuit is connected to an electrode on the transducer for sensing the transducer strain.

20. A circuit in accordance with claim 16 wherein the controller is programmed to detect the feedback signal while the transducer is being driven in audible oscillation by the driving circuit, the controller incrementally changing the controller output frequency in one direction, detecting whether the changed frequency results in an increase or decrease of the feedback signal, changing the frequency further in the same direction when an increase of the feedback signal was the result of the frequency change and changing the frequency in the opposite direction when a decrease of the feedback signal was the result of the frequency change.

21. A circuit in accordance with claim 16 wherein the controller is programmed to detect the ambient sound level to allow a modification of the transducer drive to achieve an increased sound level and signal modulation to be recognizable in high ambient conditions without being excessive in low ambient noise conditions.

22. A circuit in accordance with claim 21 wherein the said controller detection of the sound level comprises monitoring the voltage across the audio transducer while the transducer is not being driven in audible oscillation by the driving circuit when the transducer oscillation amplitude represents ambient noise, the controller increasing the duty cycle or frequency modulation of the controller output in response to increased ambient noise and decreasing the duty cycle or frequency modulation in response to decreased ambient noise.

23. A method for generating sound in the audible frequency range, the method comprising:

(a) programmatically generating a sequence of output pulses from a controller operating under control of a finite state machine program stored in the controller, the pulses having a pulse rate for generating a selected audible frequency and a duty cycle for generating a selected amplitude;

(b) storing electrical energy in an inductor in response to each pulse; and (c) transferring energy stored in the inductor to an audio transducer during the interval between each pulse.

24. A method in accordance with claim 23 and further comprising programmatically changing the selected audible frequency or duty cycle in response to an input to the controller.

25. A method in accordance with claim 24 and further comprising feeding back to the controller a signal from the audio transducer and programmatically changing the audible frequency or duty cycle in response to the fed back signal.

* * * * *